US006732069B1

(12) United States Patent
Ekudden et al.

(10) Patent No.: US 6,732,069 B1
(45) Date of Patent: May 4, 2004

(54) LINEAR PREDICTIVE ANALYSIS-BY-SYNTHESIS ENCODING METHOD AND ENCODER

(75) Inventors: Erik Ekudden, Åkersberga (SE); Roar Hagen, Stockholm (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/396,300

(22) Filed: Sep. 15, 1999

(30) Foreign Application Priority Data

Sep. 16, 1998 (SE) ..... 9803165

(51) Int. Cl.[7] ..... G10L 19/04
(52) U.S. Cl. ..... 704/219; 704/222
(58) Field of Search ..... 704/219, 220, 704/222, 223, 264, 265, 230, 229

(56) References Cited

U.S. PATENT DOCUMENTS 5,553,191 A * 9/1996 Minde ..... 704/220
RE36,721 E * 5/2000 Akamine et al. ..... 704/220
6,085,158 A * 7/2000 Naka et al. ..... 704/228
6,104,992 A * 8/2000 Gao et al. ..... 704/230
6,199,037 B1 * 3/2001 Hardwick ..... 704/208
6,260,010 B1 * 7/2001 Gao et al. ..... 704/230

FOREIGN PATENT DOCUMENTS

| | | | |
|---|---|---|---|
| CA | 2 118 986 | A | 9/1995 |
| EP | 0577 488 | A1 | 1/1994 |
| EP | 0684 705 | A2 | 11/1995 |
| EP | 0764 939 | A2 | 3/1997 |
| WO | WO 96/35208 | | 11/1996 |

OTHER PUBLICATIONS

Kataoka, A., et al.; "An 8–kb/s Conjugate Structure CELP (CS–CELP) Speech Coder," IEEE Transactions on Speech and Audio Processing, vol. 4, No. 6, Nov. 1996, pp. 401–411, XPOOO785317.

Lange, J.; EPO Standard Search Report No. RS 101640; Mar. 26, 1999, pp. 1–2.

A. Kataoka et al., *An 8–kb/s Conjugate Structure CELP (CS–CELP)Speech Coder*, Nov. 1996, IEEE Transactions on Speech and Audio Processing, vol. 4, No. 6, pp. 401–411.

P. Gjervaldsaeter; International Search Report on International App. No. PCT/SE99/01433; Mar. 6, 2000, pp. 1–4.

* cited by examiner

*Primary Examiner*—Daniel Abebe

(57) ABSTRACT

A linear predictive analysis-by-synthesis encoder includes a search algorithm block (50) and a vector quantizer (58) for vector quantizing optimal gains from a plurality of subframes in a frame. The internal encoder states are updated (50, 52, 54, 56) using the vector quantized gains.

14 Claims, 3 Drawing Sheets

LINEAR PREDICTIVE ANALYSIS-BY-SYNTHESIS ENCODING METHOD AND ENCODER

TECHNICAL FIELD

The present invention relates to a linear predictive analysis-by-synthesis (LPAS) encoding method and encoder.

BACKGROUND OF THE INVENTION

The dominant coder model in cellular application is the Code Excited Linear Prediction (CELP) technology. This waveform matching procedure is known to work well, at least for bit rates of say 8 kb/s or more. However, when lowering the bit rate, the coding efficiency decreases as the number of bits available for each parameter decreases and the quantization accuracy suffers.

[1] and [2] suggest methods of collectively vector quantizing gain parameter related information over several subframes. However, these methods do not consider the internal states of the encoder and decoder. The result will be that the decoded signal at the decoder will differ from the optimal synthesized signal at the encoder.

SUMMARY OF THE INVENTION

An object of the present invention is a linear predictive analysis-by-synthesis (LPAS) CELP based encoding method and encoder that is efficient at low bitrates, typically at bitrates below 8 kbits/s, and which synchronizes its internal states with those of the decoder.

This object is solved in accordance with the appended claims.

Briefly, the present invention increases the coding efficiency by vector quantizing optimal gain parameters of several subframes. Thereafter the internal encoder states are updated using the vector quantized gains. This reduces the number of bits required to encode a frame while maintaining the synchronization between internal states of the encoder and decoder.

BRIEF DESCRIPTION OF THE DRAWINGS

The invention, together with further objects and advantages thereof, may best be understood by making reference to the following description taken together with the accompanying drawings, in which.

DETAILED DESCRIPTION OF PREFERRED EMBODIMENTS

In order to better understand the present invention, this specification will start with a short description of a typical LPAS encoder.

Figure 1:
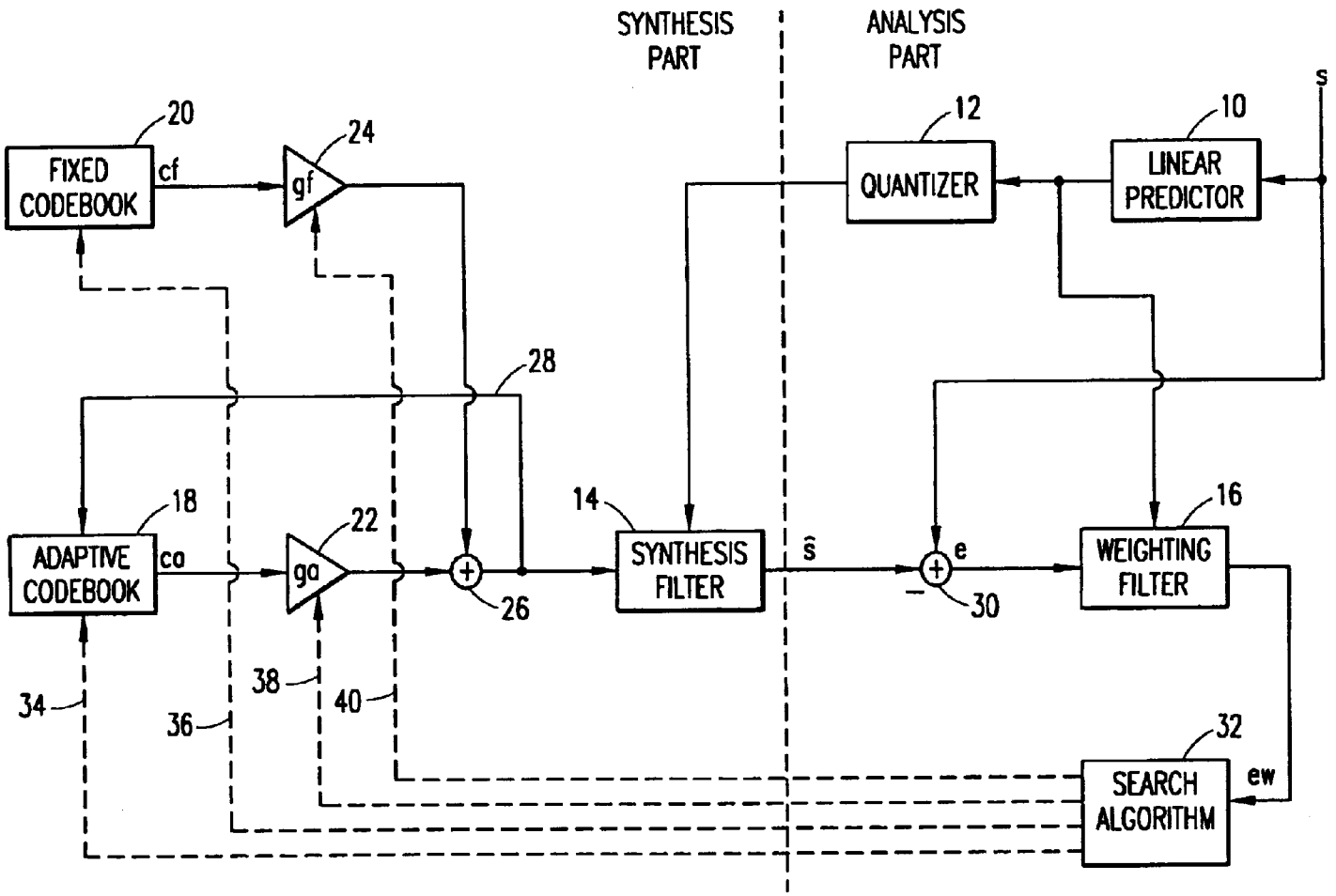
FIG. 1 (PRIOR ART)
FIG. 1 is a block diagram illustrating a typical prior art LPAS encoder.

FIG. 1 is a block diagram illustrating such a typical prior art LPAS encoder. The encoder comprises an analysis part and a synthesis part.

In the analysis part a linear predictor 10 receives speech frames s (typically 20 ms of speech sampled at 8000 Hz) and determines filter coefficients for controlling, after quantization in a quantizer 12, a synthesis filter 12 (typically an all-pole filter of order 10). The unquantized filter coefficients are also used to control a weighting filter 16.

In the synthesis part code vectors from an adaptive codebook 18 and a fixed codebook 20 are scaled in scaling elements 22 and 24, respectively, and the scaled vectors are added in an adder 26 to form an excitation vector that excites synthesis filter 14. This results in a synthetic speech signal $\hat{s}$. A feedback line 28 updates the adaptive codebook 18 with new excitation vectors.

An adder 30 forms the difference e between the actual speech signal s and the synthetic speech signal $\hat{s}$. This error e signal is weighted in weighting filter 16, and the weighted error signal ew is forwarded to a search algorithm block 32. Search algorithm block 32 determines the best combination of code vectors ca, cf from codebooks 18, 20 and gains ga, gf in scaling elements 22, 24 over control lines 34, 36, 38 and 40, respectively, by minimizing the distance measure:

$$D=81\ ew\|^2=\|W\cdot(s-\hat{s})\|=\|W\cdot s-W\cdot H\cdot(ga\cdot ca+gf\cdot cf)\|^2 \quad (1)$$

over a frame. Here W denotes a weighting filter matrix and H denotes a synthesis filter matrix.

The search algorithm may be summarized as follows:

For each frame:

1. Compute the synthesis filter 14 by linear prediction and quantize the filter coefficients.
2. Interpolate the linear prediction coefficients between the current and previous frame (in some domain, e.g. the Line Spectrum Frequencies) to obtain linear prediction coefficients for each subframe (typically 5 ms of speech sampled at 8000 Hz, i.e. 40 samples). The weighting filter 16 is computed from the linear prediction filter coefficients.

For each subframe within the frame:

1. Find code vector ca by searching the adaptive codebook 18, assuming that gf is zero and that ga is equal to the optimal (unquantized) value.
2. Find code vector cf by searching the fixed codebook 20 and using the code vector ca and gain ga found in the previous step. Gain gf is assumed equal to the (unquantized) optimal value.
3. Quantize gain factors ga and gf. The quantization method may be either scalar or vector quantization.
4. Update the adaptive codebook 18 with the excitation signal generated from ca and cf and the quantized values of ga and gf. Update the state of synthesis and weighting filter.

In the described structure each subframe is encoded separately. This makes it easy to synchronize the encoder and decoder, which is an essential feature of LPAS coding. Due to the separate encoding of subframes the internal states of the decoder, which corresponds to the synthesis part of an encoder, are updated in the same way during decoding as the internal states of the encoder were updated during encoding. This synchronizes the internal states of encoder and decoder. However, it is also desirable to increase the use of vector quantization as much as possible, since this method is known to give accurate coding at low bitrates. As will be shown below, in accordance with the present invention it is possible to vector quantize gains in several subframes simultaneously and still maintain synchronization between encoder and decoder.

The present invention will now be described with reference to FIGS. 2 and 3.

Figure 2:
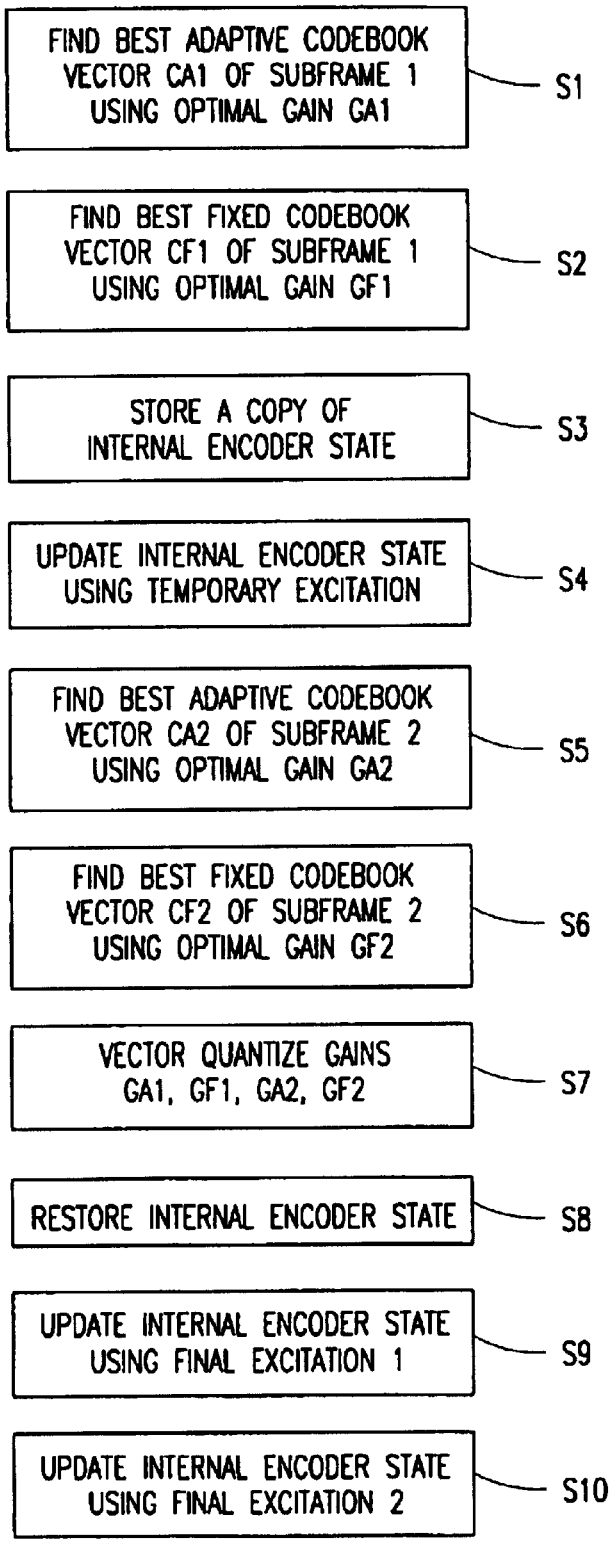
FIG. 2 is a flow chart illustrating the method in accordance with the present invention.

FIG. 2 is a flow chart illustrating the method in accordance with the present invention. The following algorithm may be used to encode 2 consecutive subframes (assuming that linear prediction analysis, quantization and interpolation have already been performed in accordance with the prior art):

S1. Find the best adaptive codebook vector ca1 (of subframe length) for subframe 1 by minimizing the weighted error:

$$DA1 = \|sw1 - \tilde{s}w1\|^2 = \|W1 \cdot s1 - W1 \cdot H1 \cdot ga1 \cdot ca1\|^2 \quad (2)$$

of subframe 1. Here "1" refers to subframe 1 throughout equation (2). Furthermore, it is assumed that the optimal (unquantized) value of ga1 is used when evaluating each possible ca1 vector.

S2. Find the best fixed codebook vector cf1 for subframe 1 by minimizing the weighted error:

$$DF1 = \|sw1 - \tilde{s}w\|^2 = \|W1 \cdot s1 - W1 \cdot H1 \cdot (ga1 \cdot ca1 + gf1 \cdot cf1)\|^2 \quad (3)$$

assuming that the optimal gf1 value is used when evaluating each possible cf1 vector. In this step the ca1 vector that was determined in step S1 and the optimal ga1 value are used.

S3. Store a copy of the current adaptive codebook state, the current synthesis filter state as well as the current weighting filter state. The adaptive codebook is a FIFO (Fist In First Out) element. The state of this element is represented by the values that are currently in the FIFO. A filter is a combination of delay elements, scaling elements and adders. The state of a filter is represented by the current input signals to the delay elements and the scaling values (filter coefficients).

S4. Update the adaptive codebook state, the synthesis filter state, as well as the weighting filter state using the temporary excitation vector $$\tilde{x}1 = ga1 \cdot ca1 + gf1 \cdot cf1$$

of subframe 1 found in steps S1 and S2. Thus, this vector is shifted into the adaptive codebook (and a vector of the same length is shifted out of the adaptive codebook at the other end). The synthesis filter state and the weighting filter state are updated by updating the respective filter coefficients with their interpolated values and by feeding this excitation vector through the synthesis filter and the resulting error vector through the weighting filter.

S5. Find the best adaptive codebook vector ca2 for subframe 2 by minimizing the weighted error:

$$DA2 = \|sw2 - \tilde{s}w2\|^2 = \|W2 \cdot s2 - W2 \cdot H2 \cdot ga2 \cdot ca2\|^2 \quad (4)$$

of subframe 2. Here "2" refers to subframe 2 throughout equation (4). Furthermore, it is assumed that the (unquantized) optimal value of ga2 is used when evaluating each possible ca2 vector.

S6. Find the best fixed codebook vector cf2 for subframe 2 by minimizing the weighted error:

$$DF2 = \|sw2 - \tilde{s}w2\|^2 = \|W2 \cdot s2 - W2 \cdot H2 \cdot (ga2 \cdot ca2 + gf2 \cdot cf2)\|^2 \quad (5)$$

assuming that the optimal gf2 value is used when evaluating each possible cf2 vector. In this step the ca2 vector that was determined in step S5 and the optimal ga2 value are used.

S7. Vector quantize all 4 gains ga1, gf1, ga2 and gf2. The corresponding quantized vector [ĝa1 ĝf1 ĝa2d ĝf2] is obtained from a gain codebook by the vector quantizer. This codebook may be represented as:

$$[\hat{g}a1\ \hat{g}f1\ \hat{g}a2\ \hat{g}f2]^T \epsilon \{[c_i(0)\ c_i(1)\ c_i(2)\ c_i(3)]^T\}_{i=0}^{N-1} \quad (6)$$

where $c_i(0)$, $c_i(1)$, $c_i(2)$ and $c_i(3)$ are the specific values that the gains can be quantized to. Thus, an index i, that can be varied from 0 to N−1, is selected to represent all 4 gains, and the task of the vector quantizer is to find this index. This is achieved by minimizing the following expression:

$$DG = \alpha \cdot DG1 + \beta \cdot DG2 \quad (7)$$

where α, β are constants and the gain quantization criteria for the $1^{st}$ and $2^{nd}$ subframes are given by:

$$DG1 = \|sw1 - \tilde{s}w1\|^2 = \|W1 \cdot s1 - W1 \cdot H1 \cdot (c_i(0) \cdot ca1 + c_i(1) \cdot cf1)\|^2 \quad (8)$$

$$DG2 = \|sw2 - \tilde{s}w2\|^2 = \|W2 \cdot s2 - W2 \cdot H2 \cdot (c_i(2) \cdot ca2 + c_i(3) \cdot cf2)\|^2 \quad (9)$$

Therefore $$j = \underset{i \epsilon \{0, N-1\}}{\operatorname{argmin}} \{\alpha \cdot DG1 + \beta \cdot DG2\} \quad (10)$$

and $$[\hat{g}a1\ \hat{g}f1\ \hat{g}a2\ \hat{g}f2]^T = [c_j(0)\ c_j(1)\ c_j(2)\ c_j(3)]^T \quad (11)$$

S8. Restore the adaptive codebook state, synthesis filter state and weighting filter state by retrieving the states stored in step S3.

S9. Update the adaptive codebook, synthesis filter and weighting filter using the final excitation for the $1^{st}$ subframe, this time with quantized gains, i.e.

$$\hat{x}1 = \hat{g}a1 \cdot ca1 + \hat{g}f1 \cdot cf1.$$

S10. Update the adaptive codebook, synthesis filter and weighting filter using the final excitation for the $2^{nd}$ subframe, this time with quantized gains, i.e.

$$\hat{x}2 = \hat{g}a2 \cdot ca2 + \hat{g}f2 \cdot cf2$$

The encoding process is now finished for both subframes. The next step is to repeat steps S1–S10 for the next 2 subframes or, if the end of a frame has been reached, to start a new encoding cycle with linear prediction of the next frame.

The reason for storing and restoring states of the adaptive codebook, synthesis filter and weighting filter is that not yet quantized (optimal) gains are used to update these elements in step S4. However, these gains are not available at the decoder, since they are calculated from the actual speech signal s. Instead only the quantized gains will be available at the decoder, which means that the correct internal states have to be recreated at the encoder after quantization of the gains. Otherwise the encoder and decoder will not have the same internal states, which would result in different synthetic speech signals at the encoder and decoder for the same speech parameters.

The weighting factors α, β in equations (7) and (10) are included to account for the relative importance of the $1^{st}$ and $2^{nd}$ subframe. They are advantageously determined by the energy parameters such that high energy subframes get a lower weight than low energy subframes. This improves performance at onsets (start of word) and offsets (end of word). Other weighting functions, for example based on voicing during non onset or offset segments, are also feasible. A suitable algorithm for this weighting process may be summarized as:

If the energy of subframe 2>2 times the energy of subframe 1 then let $\alpha=2\beta$

If the energy of subframe 2<0.25 times the energy of subframe 1 then let $\alpha=0.5\beta$ otherwise let $\alpha=\beta$

Figure 3:
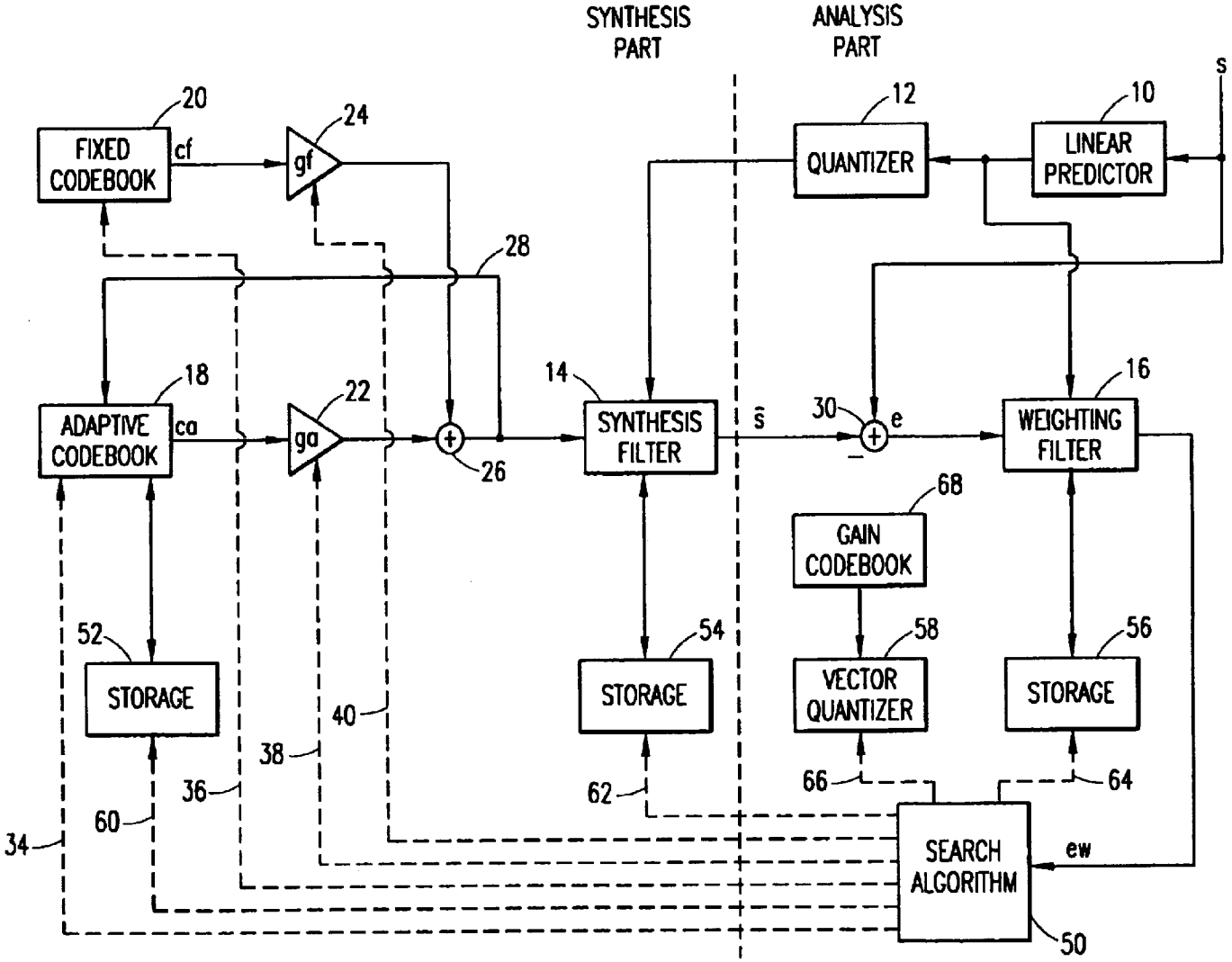
FIG. 3 is a block diagram illustrating an embodiment of an LPAS encoder in accordance with the present invention.

FIG. 3 is a block diagram illustrating an embodiment of an LPAS encoder in accordance with the present invention. Elements 10–40 correspond to similar elements in FIG. 1. However, search algorithm block 32 has been replaced by a search algorithm block 50 that in addition to the codebooks and scaling elements controls storage blocks 52, 54, 56 and a vector quantizer 58 over control lines 60, 62, 64 and 66, respectively. Storage blocks 52, 54 and 56 are used to store and restore states of adaptive codebook 18, synthesis filter 14 and weighting filter 16, respectively. Vector quantizer 58 finds the best gain quantization vector from a gain codebook 68.

The functionality of algorithm search block 50 and vector quantizer 58 is, for example, implemented as on ore several micro processors or micro/signal processor combinations.

In the above description it has been assumed that gains of 2 subframes are vector quantized. If increase complexity is acceptable, a further performance improvement may be obtained by extending this idea and vector quantize the gains of all the subframes of a speech frame. This requires backtracking of several subframes in order to obtain the correct final internal states in the encoder after vector quantization of the gains.

Thus, it has been shown that vector quantization of gains over subframe boundaries is possible without sacrifying the synchronization between encoder and decoder. This significantly improves compression performance and allows significant bitrate savings. For example, it has been found that when 6 bits are used for 2 dimensional vector quantization of gains in each subframe, 8 bits may be use in 4 dimensional vector quantization of gains of 2 subframes without loss of quality. Thus, 2 bits per subframe are saved (½(2*6–8) ). This corresponds to 0.4 kbits/s for 5 ms subframes, a very significant saving at low bit rates (below 8 kbits/s, for example).

It is to be noted that no extra algorithmic delay is introduced, since processing is changed only at subframe and not at frame level. Furthermore, this changed processing is associated with only a small increase in complexity.

The preferred embodiment, which includes error weighting between subframes ($\alpha$, $\beta$) leads to improved speech quality.

It will be understood by those skilled in the art that various modifications and changes may be made to the present invention without departure from the scope thereof, which is defined by the appended claims.

REFERENCES

[1] EP 0 764 939 (AT & T), page 6, paragraph A—page 7.

[2] EP 0 684 705 (Nippon Telegraph & Telephone), col. 39, line 17—col. 40, line 4

What is claimed is:

1. A linear predictive analysis-by-synthesis coding method, including the steps of determining optimum gains of a plurality of subframes;

collectively vector quantizing said optimum gains; and updating internal encoder states using said collective vector quantized gains.

2. The method of claim 1, including the steps of storing an internal encoder state after encoding of a subframe with optimal gains;

restoring said internal encoder state after vector quantization of gains from several subframes; and updating said internal encoder states by using determined codebook vectors and said vector quantized gains.

3. The method of claim 2, wherein said internal encoder state include an adaptive codebook state, a synthesis filter state and a weighting filter state.

4. The method of claim 1, 2 or 3, wherein gains from 2 subframes are vector quantized.

5. The method of claim 1, 2 or 3, wherein all gains from all subframes of said frame are vector quantized.

6. The method of claim 1, including the steps of:

weighting error contributions from different subframes by weighting factors; and minimizing the sum of the weighted error contributions.

7. The method of claim 6, wherein each weighting factor depends on the energy of its corresponding subframe.

8. A linear predictive analysis-by-synthesis encoder, including a search algorithm block for determining optimum gains of a plurality of subframes;

a vector quantizer for collectively vector quantizing said optimum gains; and means for updating internal encoder states using said collective vector quantized gains.

9. The encoder of claim 8, including means for storing an internal encoder state after encoding of a subframe with optimal gains;

means for restoring said internal encoder state after vector quantization of gains from several subframes; and means for updating said internal encoder states by using determined codebook vectors and said vector quantized gains.

10. The encoder of claim 9, wherein said means for storing said internal encoder state includes an adaptive codebook state storing means, a synthesis filter state storing means and a weighting filter state storing means.

11. The encoder of claim 8, 9 or 10, including means for vector quantizing gains from 2 subframes.

12. The encoder of claim 8, 9 or 10, including means for vector quantizing all gains from all subframes of a speech frame.

13. The encoder of claim 8, including means (58) for weighting error contributions from different subframes by weighting factors and minimizing the sum of the weighted error contributions.

14. The encoder of claim 13, including means for determining weighting factors that depend on the energy of corresponding subframes.

* * * * *